US011015812B2

(12) United States Patent
Petty, Sr. et al.

(10) Patent No.: US 11,015,812 B2
(45) Date of Patent: May 25, 2021

(54) COMBUSTOR BOLTED SEGMENTED ARCHITECTURE

(71) Applicants: Rolls-Royce North American Technologies Inc., Indianapolis, IN (US); Rolls-Royce Corporation, Indianapolis, IN (US)

(72) Inventors: Jack D. Petty, Sr., Indianapolis, IN (US); John D. Holdcraft, Carmel, IN (US); Kevin M. Sauer, Plainfield, IN (US); Duane A. Smith, Carmel, IN (US)

(73) Assignees: Rolls-Royce North American Technologies Inc., Indianapolis, IN (US); Rolls-Royce Corporation, Indianapolis, IN (US)

( * ) Notice: Subject to any disclaimer, the term of this patent is extended or adjusted under 35 U.S.C. 154(b) by 280 days.

(21) Appl. No.: 15/972,309

(22) Filed: May 7, 2018

(65) Prior Publication Data

US 2019/0338953 A1 Nov. 7, 2019

(51) Int. Cl.

| | |
|---|---|
| ***F23R 3/60*** | (2006.01) |
| ***F23R 3/50*** | (2006.01) |
| ***F23R 3/00*** | (2006.01) |
| ***F23R 3/06*** | (2006.01) |
| ***F23M 5/04*** | (2006.01) |

(52) U.S. Cl.

CPC ..... *F23R 3/60* (2013.01); *F23M 5/04* (2013.01); *F23R 3/002* (2013.01); *F23R 3/06* (2013.01); *F23R 3/50* (2013.01); *F23R 2900/00017* (2013.01); *F23R 2900/00018* (2013.01); *F23R 2900/03043* (2013.01)

(58) Field of Classification Search

CPC ..... F23R 3/002; F23R 3/60

See application file for complete search history.

(56) References Cited

U.S. PATENT DOCUMENTS 3,031,844 A * 5/1962 Tomolonius ..... F23R 3/002 60/752
3,657,883 A * 4/1972 De Corso ..... F23R 3/46 60/39.37
3,854,503 A * 12/1974 Nelson ..... F23D 11/404 138/37

(Continued)

FOREIGN PATENT DOCUMENTS

EP 3 054 218 A1 8/2016
FR 2896304 B1 * 1/2013 ..... F23R 3/10

*Primary Examiner* — Gerald L Sung
*Assistant Examiner* — Marc J Amar
(74) *Attorney, Agent, or Firm* — Brinks Gilson & Lione

(57) ABSTRACT

A combustor liner assembly is provided including an inlet wall, an inner wall, an outer wall, and a plurality of fasteners. The inlet wall has an opening into a combustion chamber. The inner wall is coupled to the inlet wall at a first end of the combustor liner. The inner wall defines a radially inner end of the combustion chamber. The outer wall includes a plurality of segments. The plurality of segments define a radially outer end of the combustion chamber. A first portion of the plurality of fasteners couples each of the plurality of segments to another of the plurality of segments. A second portion of the plurality of fasteners couples at least one of the plurality of segments to the inlet wall at the first end of the combustor liner.

13 Claims, 6 Drawing Sheets

(56) References Cited

U.S. PATENT DOCUMENTS 4,158,949 A * 6/1979 Reider ..... F23R 3/50 60/737
4,380,896 A 4/1983 Wiebe
4,422,300 A 12/1983 Dierberger et al.
4,485,630 A 12/1984 Kenworthy
4,555,901 A * 12/1985 Wakeman ..... F23R 3/08 60/752
4,567,730 A 2/1986 Scott
4,614,082 A 9/1986 Sterman et al.
4,720,970 A * 1/1988 Hudson ..... F02C 3/14 60/39.37
4,773,227 A 9/1988 Chabis
5,333,443 A 8/1994 Halila
5,363,643 A 11/1994 Halila
6,868,675 B1 * 3/2005 Kuhn ..... F23R 3/002 60/772
7,673,457 B2 * 3/2010 Bessagnet ..... F23R 3/283 60/752
7,757,495 B2 * 7/2010 Bessagnet ..... F23R 3/10 60/800
8,146,372 B2 * 4/2012 Carrere ..... F23R 3/007 60/804
8,453,455 B2 6/2013 Bastnagel et al.
9,328,926 B2 * 5/2016 Penz ..... F23R 3/002
2004/0035115 A1 * 2/2004 Farmer ..... F23R 3/002 60/752
2009/0235667 A1 * 9/2009 Gerendas ..... F23R 3/007 60/753
2012/0240583 A1 9/2012 Penz et al.
2012/0255308 A1 10/2012 Chandler et al.
2015/0260409 A1 * 9/2015 Clemen ..... F23R 3/60 60/798
2016/0258624 A1 9/2016 Harding et al.
2016/0265771 A1 * 9/2016 Max ..... F23R 3/58
2017/0045227 A1 * 2/2017 Harding ..... F23R 3/002
2017/0299187 A1 * 10/2017 Berry ..... F23R 3/50
2018/0017257 A1 1/2018 Riehle
2018/0036843 A1 * 2/2018 Hucker ..... F23R 3/002
2020/0018238 A1 * 1/2020 Ryon ..... F02C 7/222

* cited by examiner

COMBUSTOR BOLTED SEGMENTED ARCHITECTURE

TECHNICAL FIELD

This disclosure relates to combustors for gas turbine engines, and, in particular to combustor liners within combustors.

BACKGROUND

Combustors typically include combustor liners which surround the combustion chamber. Combustor liners may be intermittently exposed to high thermal stress over a long period of time. Failure to one portion of a combustor liner often requires complete replacement of the combustor liner.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

Typically, the temperature of gases within a combustion chamber of a gas turbine engine are as high as possible to maximize efficiency of the gas turbine engine. Furthermore, thermal stress within the combustion chamber may not be uniform, causing increased wear on different portions of the combustor liner. Failure of any portion of the combustor liner may require replacement of the entire combustor liner. Therefore, it is desirable that components of the combustor liner may be easily changed to increase the life of the combustor and decrease maintenance costs associated with operation of the gas turbine engine.

The following description is merely exemplary in nature and is not intended to limit the present disclosure, application, or uses.

By way of an introductory example, a combustor liner assembly is provided including an inlet wall, an inner wall, an outer wall, and a plurality of fasteners. The inlet wall has an opening into a combustion chamber. The inner wall is coupled to the inlet wall at a first end of the combustor liner. The inner wall defines a radially inner end of the combustion chamber. The outer wall includes a plurality of segments. The plurality of segments define a radially outer end of the combustion chamber. A first portion of the plurality of fasteners couples each of the plurality of segments to another of the plurality of segments. A second portion of the plurality of fasteners couples at least one of the plurality of segments to the inlet wall at the first end of the combustor liner.

One interesting feature of the systems and methods described below may be that the segments may be easily interchangeable to repair worn or damaged areas of the combustor liner. Such replacements may increase the life of the combustor. Alternatively, or in addition, an interesting feature of the systems and methods described below may be that the segments may be similar or identical in design, reducing the maintenance cost for the combustor liner and may reduce the number of parts in the combustor liner. Alternatively, or in addition, an interesting feature of the systems and methods described below may be that the incorporation of the segments into the combustion liner may reduce the weight of the combustor liner. Alternatively, or in addition, an interesting feature of the systems and methods described below may be that a segmented combustor liner may still retain hoop integrity of the combustor liner while still eliminating forward and aft rings used in other combustor liner designs.

Figure 1:
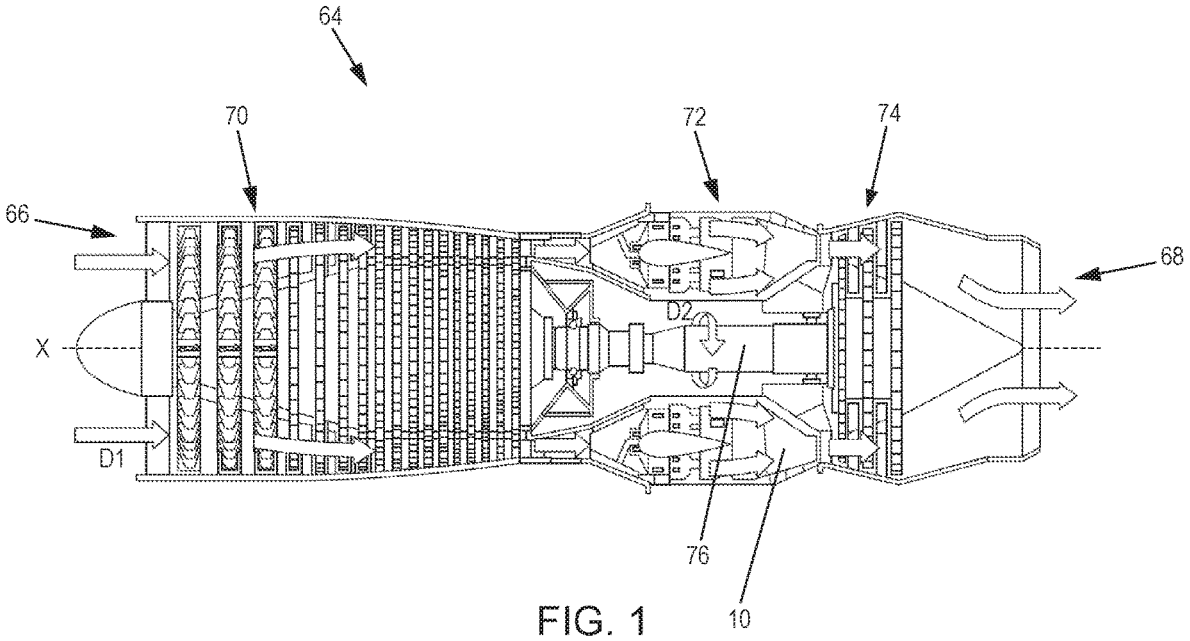
FIG. 1 illustrates a cross-sectional view of an example of a gas turbine engine.

FIG. 1 illustrates a cross-sectional view of a gas turbine engine 64 for propulsion of, for example, an aircraft. Alternatively or in addition, the gas turbine engine 64 may be used to drive a propeller in aquatic applications, or to drive a generator in energy applications. The gas turbine engine 64 may include an intake section 66, a compressor section 70, a combustor section 72, a turbine section 74, and an exhaust section 68. During operation of the gas turbine engine 64, fluid received from the intake section 66, such as air, travels along the direction D1 and may be compressed within the compressor section 70. The compressed fluid may then be mixed with fuel and the mixture may be burned in the combustor section 72. The combustor section 72 may include any suitable fuel injection and combustion mechanisms. The combustor section 72 may also contain a combustor liner 10. The combustor liner 10 may be any object which surrounds and defines the combustion chamber (34 in FIG. 2). Examples of the combustor liner 10 may include an annular cylinder, a can, or a pair of concentric rings. The hot, high pressure fluid may then pass through the turbine section 74 to extract energy from the fluid and cause the turbine section 74 to rotate, which in turn drives the a shaft 76 which drives the compressor section 70. Discharge fluid may exit the exhaust section 68.

The shaft 76 may rotate around an axis of rotation, which may correspond to a centerline X in some examples. The centerline X may be a longitudinal axis which extends across the entire length of the shaft 76, along the axis of rotation. For the purposes of this application, the terms "radially outer" and "radially outward" may describe the position of an element with respect to its distance away from the centerline X of the gas turbine engine 64 or the center of the shaft 76. The terms "radially inner" and "radially inward" may describe the position of an element with respect to its distance toward the centerline X of the gas turbine engine 64 or the center of the shaft 76. A "downstream" direction may be any direction toward the exhaust section 68 of the gas turbine engine 64. An upstream direction may be any direction toward the intake section 66 of the gas turbine engine 64.

Figure 2:
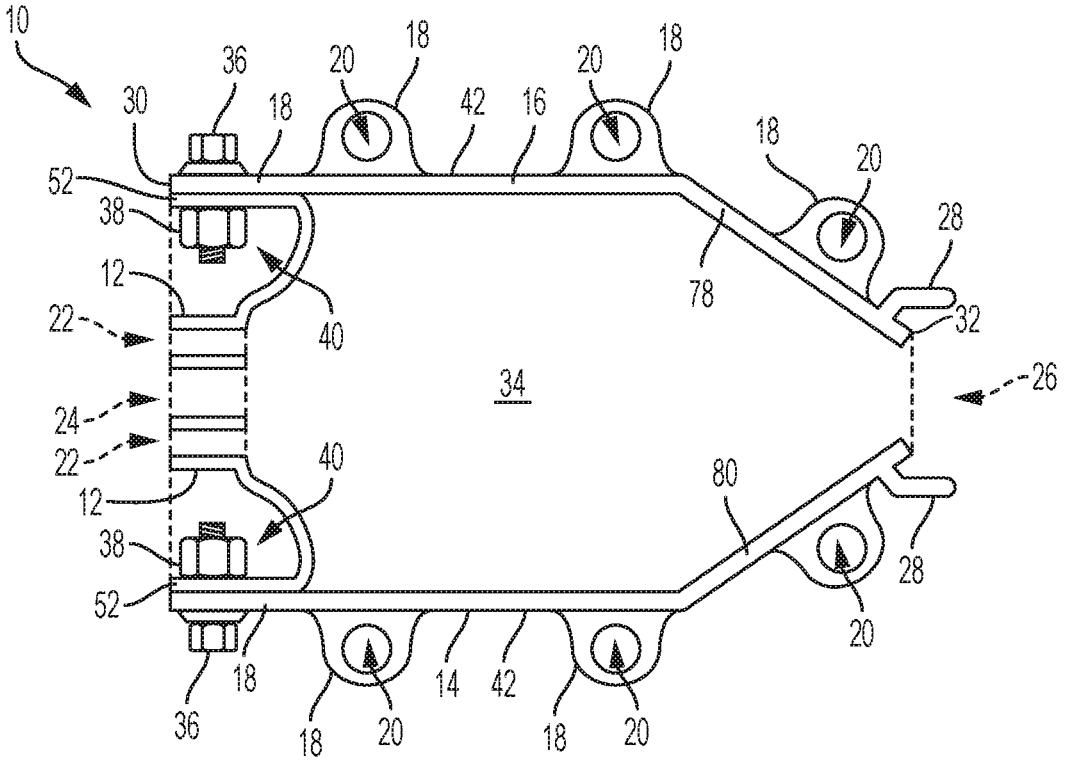
FIG. 2 illustrates a partial cross-sectional side view of a first example of a combustor liner.

FIG. 2 illustrates a partial cross-sectional view of an example of the combustor liner 10 including an inlet wall 12, an inner wall 14, and an outer wall 16. The inlet wall 12 may be any structure which allows fluid from the compressor section 70 to enter the combustion chamber 34. Examples of the inlet wall 12 may include a bracket, a plate, or panel. The inlet wall 12 may be made of any material which can provide structural support to the combustor liner 10 and contain combustion within the combustion chamber 34, such as a ceramic matrix composite material or a metal such as titanium or a nickel superalloy.

The inlet wall 12 may include an intake opening 22 which allows fluid from the compressor section 70 to enter the combustion chamber 34. Examples of the intake opening 22 may include a ringed slot, a circular opening, or a curved orifice such as a swirler. The inlet wall 12 may also include a fuel nozzle opening 24. The fuel nozzle opening 24 may be any opening through which a fuel nozzle (not shown) may extend to dispense fuel into the combustion chamber 34. Examples of the fuel nozzle opening 24 may include an orifice, a channel, or a circular passage.

The combustion chamber 34 may be any space within the combustor section 72 in which fluid from the compressor section 70 is ignited. Examples of the combustion chamber 34 may include a cavity, a space, or a passage. Fluid may enter the combustion chamber 34 from the intake opening 22 and may exit the combustion chamber 34 through an exhaust opening 26. The combustion chamber 34 may be surrounded by the combustor liner 10. The exhaust opening 26 may be any opening in the combustor liner 10 through which fluid may exit the combustion chamber 34. Example of the exhaust opening 26 may include an annular passage, a collection of spaced openings, or a directional passageway.

The inner wall 14 may be any structure which extends downstream from the inlet wall 12 and which defines a radially inner end of the combustion chamber 34. Examples of the inner wall 14 may include a cylinder, a conical tube, or a plate. The inner wall 14 may extend from a first end 30 of the combustor liner 10 to a second end 32 of the combustor liner 10. At the first end 30 of the combustor liner 10, the inner wall 14 may be coupled to the inlet wall 12. At the second end 32 of the combustor liner 10, the inner wall 14 may define a portion of the exhaust opening 26. The inner wall 14 may be made of any material which can provide structural support to the combustor liner 10 and contain combustion of fluid within the combustion chamber 34, such as a ceramic matrix composite material or a metal such as titanium or a nickel superalloy. The inner wall 14 may have an interior 80. The interior 80 of the inner wall 14 may be uniform or may have an internal architecture including, for example, advanced cooling systems.

The outer wall 16 may be any structure which extends downstream from the inlet wall 12 and which defines a radially outer end of the combustion chamber 34. Examples of the outer wall 16 may include a cylinder, a conical tube, or a plate. The outer wall 16 may extend from the first end 30 of the combustor liner 10 to the second end 32 of the combustor liner 10. At the first end 30 of the combustor liner 10, the outer wall 16 may be coupled to the inlet wall 12. At the second end 32 of the combustor liner 10, the outer wall 16 may define a portion of the exhaust opening 26. The outer wall 16 may be made of any material which can provide structural support to the combustor liner 10 and contain combustion of fluid within the combustion chamber 34, such as a ceramic matrix composite material or a metal such as titanium or a nickel superalloy. In some embodiments, the outer wall 16 may have a larger diameter and a larger circumference than the inner wall 14. The outer wall 16 may have an interior 78. The interior 78 of the outer wall 16 may be uniform or may have an internal architecture including, for example, advanced cooling systems.

The inner wall 14 and the outer wall 16 may both comprise one or more flanges 18. The flanges 18 may be any structure which extend radially from the inner wall 14 or outer wall 16. Examples of the flanges 18 may include protrusions, projections, or rims. The flanges 18 on the inner wall 14 may extend radially inward from a surface 92 of the inner wall 14 which is on the exterior of the combustion chamber 34. The flanges 18 on the outer wall 16 may extend radially outward from a surface 42 of the outer wall 16 which is on the exterior of the combustion chamber 34. The flanges 18 may also extend upstream to the first end 30 of the combustor liner 10 and may be aligned with the inlet wall 12. The flanges 18 may be integral to the inner wall 14 or outer wall 16 and may be made of the same material as the inner wall 14 or outer wall 16. The flanges 18 may include flange openings 20 which extend through the flange 18. Examples of the flange openings 20 may include channels, apertures, or passageways.

The inlet wall 12 may also include flanges 52 at the first end 30 of the combustor liner 10 which are associated with flanges 18 of the inner wall 14 and outer wall 16. In some embodiments, a first flange 52 of the inlet wall 12 may rest against the inner wall 14 and may be positioned such that the flange openings 20 of the inlet wall 12 flange 52 and the inner wall 14 flange 18 are aligned. Additionally, a second flange 52 of the inlet wall 12 may rest against the outer wall 16 and may be positioned such that the flange openings 20 of the inlet wall 12 flange 52 and the outer wall 16 flange 18 are aligned.

A fastener such as a bolt 36 may pass through the flange openings 20 of the flange 18 of the inner wall 14 and the flange 52 of the inlet wall 12. Similarly, another bolt 36 may pass through the flange openings 20 of the flange 18 of the outer wall 16 and the flange 52 of the inlet wall 12. Nuts 38 may be attached to the bolts 36 such that the flanges 18, 52 are coupled together between the bolt 36 and the nut 38. The bolts 36 and nuts 38 may be any device which passes through the flange openings 20 to couple flanges 18, 52 together. Examples of the bolts 36 may include carriage bolts, shoulder bolts, socket cap screws, or any other object which may pass through the flange opening 20 and secure one side of a flange 18, 52. Examples of the nuts 38 may include cap nuts, castle nuts, torque lock nuts, or any other object which, when attached to a bolt, can fasten the flanges 18, 52 between the bolt 36 and the nut 38.

One or both of the inner wall 14 and outer wall 16 may be coupled to the inlet wall 12 in alternative configurations, such as welding or brazing. In some embodiments, one or both of the inner wall 14 and outer wall 16 may be formed integrally to the inlet wall 12. In some embodiments, only the inner wall 14 may be fastened to the inlet wall 12 through the flanges 18, 52. In other embodiments, only the outer wall 16 may be fastened to the inlet wall 12 through the flanges 18, 52. The inner wall 14 and outer wall 16 may also be coupled to the inlet wall 12 using other fasteners such as clamps, rivets, anchors, panel fasteners, or screws. In some embodiments, washers (not shown) may be placed between the bolt 36 and the nut 38.

In some embodiments, as illustrated in FIG. 2, the inlet wall 12 may be shaped to have channels 40 proximate to the flanges 52 of the inlet wall 12. The channels 40 may be any space which can accommodate a portion of a fastener extending through the flange opening 20 of the flange 52 of the inlet wall 12. In the embodiment illustrated in FIG. 2, the channels 40 may be shaped to allow easy access to the nut 38 to tighten and loosen the nut 38 and bolt 36 connection.

In some embodiments, one or both of the inner wall 14 and the outer wall 16 may include an interfacing feature 28 which extends radially at the second end 32 of the combustor liner 10. The interfacing feature 28 may be any object which is shaped to be coupled to the turbine section 74 of the gas turbine engine 64. Examples of the interfacing feature 28 may include a projection, a tab, or a cylindrical shaped rim. The interfacing feature 28 may be integral to the inner wall 14 or the outer wall 16 and may be made of the same material as the inner wall 14 and the outer wall 16. The interfacing feature 28 may be shaped to direct the flow of fluid from the exhaust opening 26 to the turbine section 74. The interfacing feature 28 may also act as a fluid seal, preventing fluid from leaking as it flows toward the turbine section 74.

Figure 3:
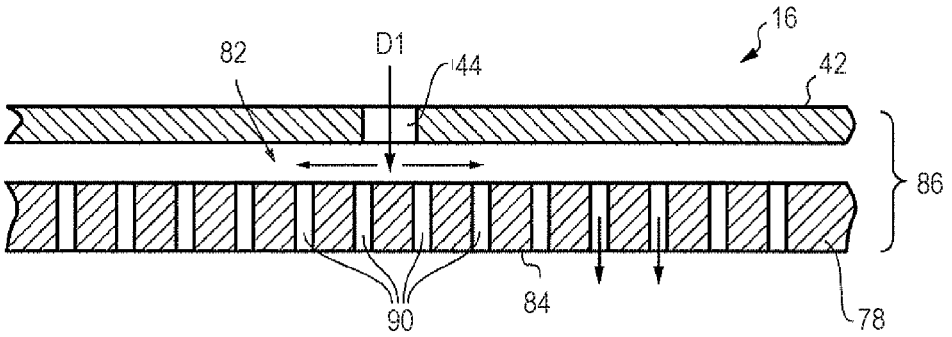
FIG. 3 illustrates a partial cross-sectional side view of a first example of an outer wall.

FIG. 3 illustrates a partial cross-sectional side view of an example of the interior 78 of the outer wall 16. In some embodiments, the outer wall 16 may include a cooling channel 82 running through the interior 78 of the outer wall 16. The cooling channel 82 may be any passage through which fluid can flow to cool the outer wall 16 of the combustor liner 10. Examples of the cooling channel 82 may include a passageway, a tube, or a complex network of pathways. Fluid may enter the cooling channel 82 through a port 44 in the exterior surface 42 of the outer wall 16. Examples of the port 44 may include an opening, an aperture, or an inlet. Fluid passing through the cooling channel 82 may be provided from the compressor section 70. Fluid passing through the cooling channel 82 may remove heat from the outer wall 16 through convection. In order to adequately cool the entire outer wall 16, the cooling channel 82 may extend from the first end 30 to the second end 32 of the outer wall 16. The fluid in the cooling channel 82 may exit the cooling channel 82 through an outlet 90 in the interior 78 of the outer wall 16. Examples of the outlet 90 may be openings, apertures, or a port. The outlet 90 may deliver fluid from the cooling channel 82 into the combustion chamber 34 or to the turbine section 74 at the second end 32 of the combustor liner 10. A similar cooling channel 82 may be formed into the interior 80 of the inner wall 14.

In some embodiments, the cooling channel 82 may be formed into the interior 78 of the outer wall 16 through machining. Alternatively, more complex and more extensive cooling channels 82 may be formed as the outer wall 16 is being formed through additive layer manufacturing. If the cooling channel 82 is designed to effectively cool the portions of the outer wall 16 under the most thermal stress, more cost effective materials, such as metals, may be used for the outer wall 16 over more complicated designs involving ceramics and ceramic-plated metals. Similar processes may be used to form a cooling channel 82 in the interior 80 of the inner wall 14.

Figure 4:
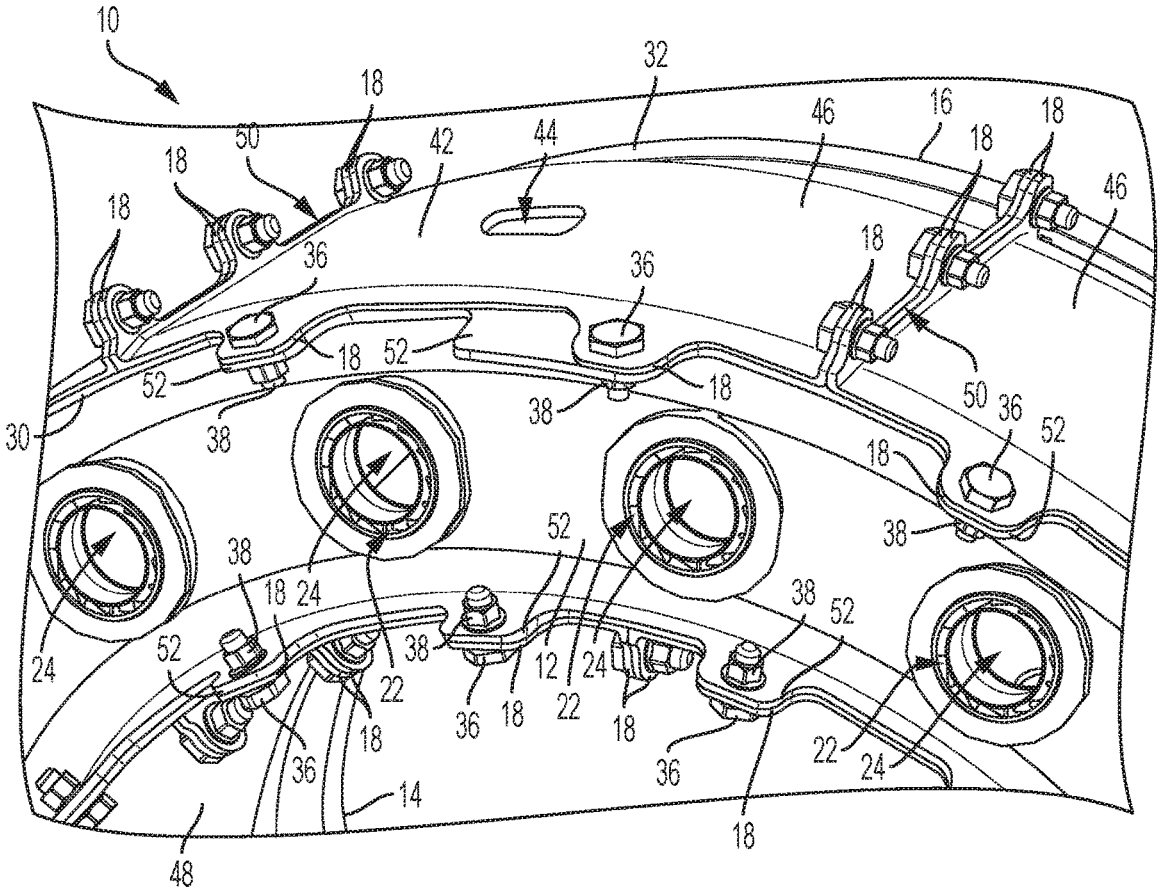
FIG. 4 illustrates a partial perspective front view of a second example of the combustor liner.

FIG. 4 illustrates a perspective view of an example of the combustor liner 10. In some embodiments, the outer wall 16 of the combustor liner 10 may include multiple outer wall segments 46 spaced about the circumference of the annular combustion chamber 34. The outer wall segments 46 may be any structure which extends around a portion of the radially outer end of the combustion chamber 34. Examples of the outer wall segments 46 may include plates, curved panels, or brackets. Each of the outer wall segments 46 may be coupled to adjacent outer wall segments 46 to form the outer wall 16. Each outer wall segment 46 may include a flange 18 facing each adjacent outer wall segment 46 such that the outer wall segments 46 may be coupled together across a joint 50 with fasteners such as nuts 38 and bolts 36. Additionally, at least one of the outer wall segments 46 may be coupled to the inlet wall 12 by fasteners such as nuts 38 and bolts 36. In some embodiments, every outer wall segment 46 may be coupled to the inlet wall 12.

Each outer wall segment 46 may be identical and easily separable from the combustor liner 10. Such a configuration may reduce the cost of maintaining the combustor liner 10, as outer wall segments 46 may be simply replaced when worn or damaged. Particularly where complex cooling channels 82 have been created in the outer wall segment 46, manufacturing identical outer wall segment 46 may be cost effective. Additionally, in some embodiments, the outer wall segments 46 may be removed and replaced without separating the combustor section 72 from the compressor section 70 and the turbine section 74.

As shown in FIG. 4, the inner wall 14 may also include multiple inner wall segments 48 spaced about the circumference of the annular combustion chamber 34. The inner wall segments 48 may be any structure which extends around a portion of the inner end of the combustion chamber 34. Examples of the inner wall segments 48 may include plates, curved panels, or brackets. Each of the inner wall segments 48 may be coupled to adjacent inner wall segments 48 to form the inner wall 14. Each inner wall segment 48 may include a flange 18 facing each adjacent inner wall segment 48 such that the inner wall segments 48 may be coupled together across joints 50 with fasteners such as nuts 38 and bolts 36. Additionally, at least one of the inner wall segments 48 may be coupled to the inlet wall 12 by a fastener such as nuts 38 and bolts 36. In some embodiments, every inner wall segment 48 may be coupled to the inlet wall 12.

Each inner wall segment 48 may be identical and easily separable from the combustor liner 10. Such a configuration may reduce the cost of maintaining the combustor liner 10, as inner wall segments 48 may be simply replaced when worn or damaged. Particularly where complex cooling channels 82 have been created in the inner wall segment 48, manufacturing identical inner wall segments 48 may be cost effective.

Figure 5:
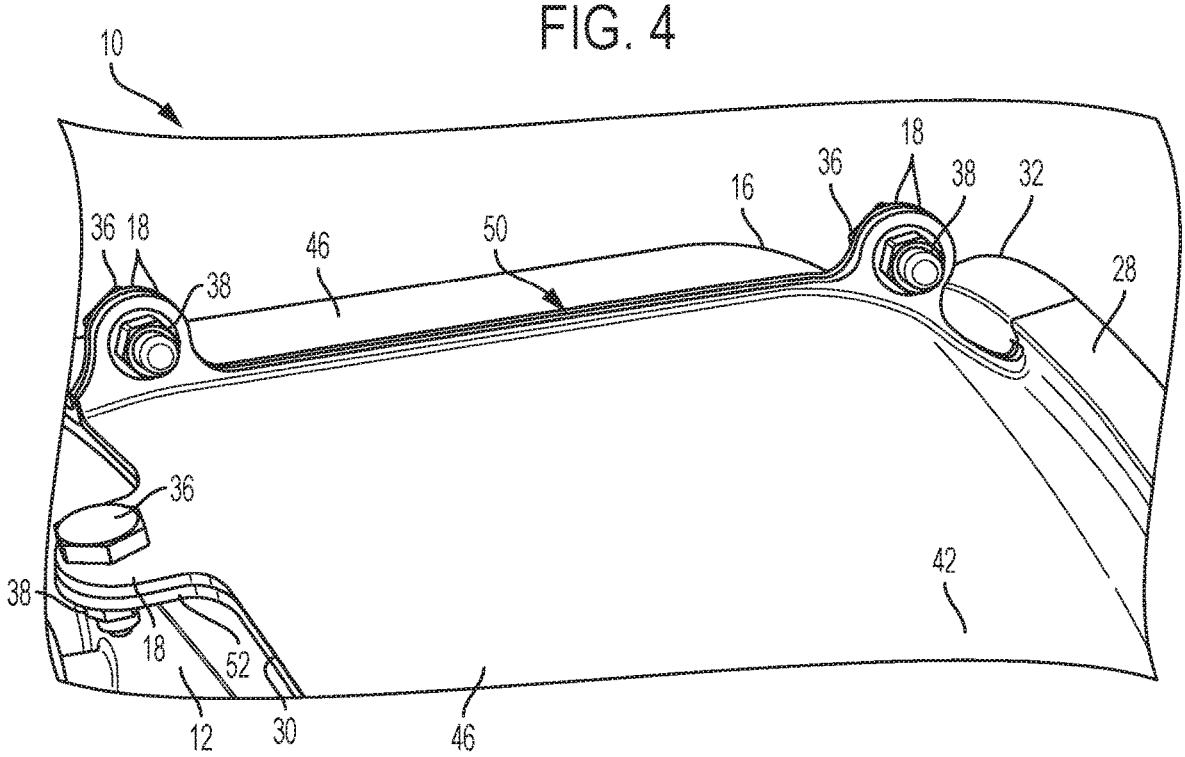
FIG. 5 illustrates a partial perspective side view of a third example of the combustor liner.

As shown in FIG. 4, each side of the outer wall segment 46 may have three flanges 18 coupled to adjacent outer wall segments 46. The flanges 18 may be spaced equally apart from one another or may be positioned to equalize mechanical stress between each flange 18. In the embodiment shown in FIG. 4, the first flange 18 is positioned at the first end 30, the second flange 18 is positioned at the second end 32, and the third flange 18 is positioned midway between the first end 30 and the second end 32. Other embodiments of the outer wall segments 46 may have more or fewer flanges 18. For example, in FIG. 5, an outer wall segment 46 is illustrated having only two flanges 18 coupled to each adjacent outer wall segment 46, wherein the first flange located at the first end 30 of the combustor liner 10 and the second flange 18 located at the second end 32. In other embodiments, each side of the outer wall segments 46 may have between one and five flanges 18 coupled to each adjacent outer wall segment 46. The number of flanges 18 needed may be dependent on the length of the joint 50 between the outer wall segments 46. There must be a minimum number of flanges 18 to overcome the mechanical stresses on the outer wall 16 and to minimize fluid loss from combustion chamber 34 through the joint 50 between outer wall segments 46. The inner wall segments 48 may have a similar arrangement of flanges 18.

Additionally, as illustrated in FIG. 4, each outer wall segment 46 may have two flanges 18 coupled to flanges 52 of the inlet wall 12 at the first end 30 of the combustor liner 10. The flanges 18 may be spaced equally apart from one another or may be positioned to equalize mechanical stress between each flange 18. Other embodiments of the outer wall segments 46 may have more or fewer flanges 18 coupled to the inlet wall 12. For example, the outer wall segments 46 may have between one and ten flanges 18 coupled to the inlet wall 12. The number of flanges 18 needed may be dependent on the length of the joint 50 between the outer wall segment 46 and the inlet wall 12. There must be a minimum number of flanges 18 to overcome the mechanical stresses on the combustor liner 10 and to minimize fluid loss from combustion chamber 34 through the joint 50 between outer wall segment 46 and the inlet wall 12. The inner wall segments 48 may have a similar arrangement of flanges 18 coupled to the inlet wall 12.

Figure 6:
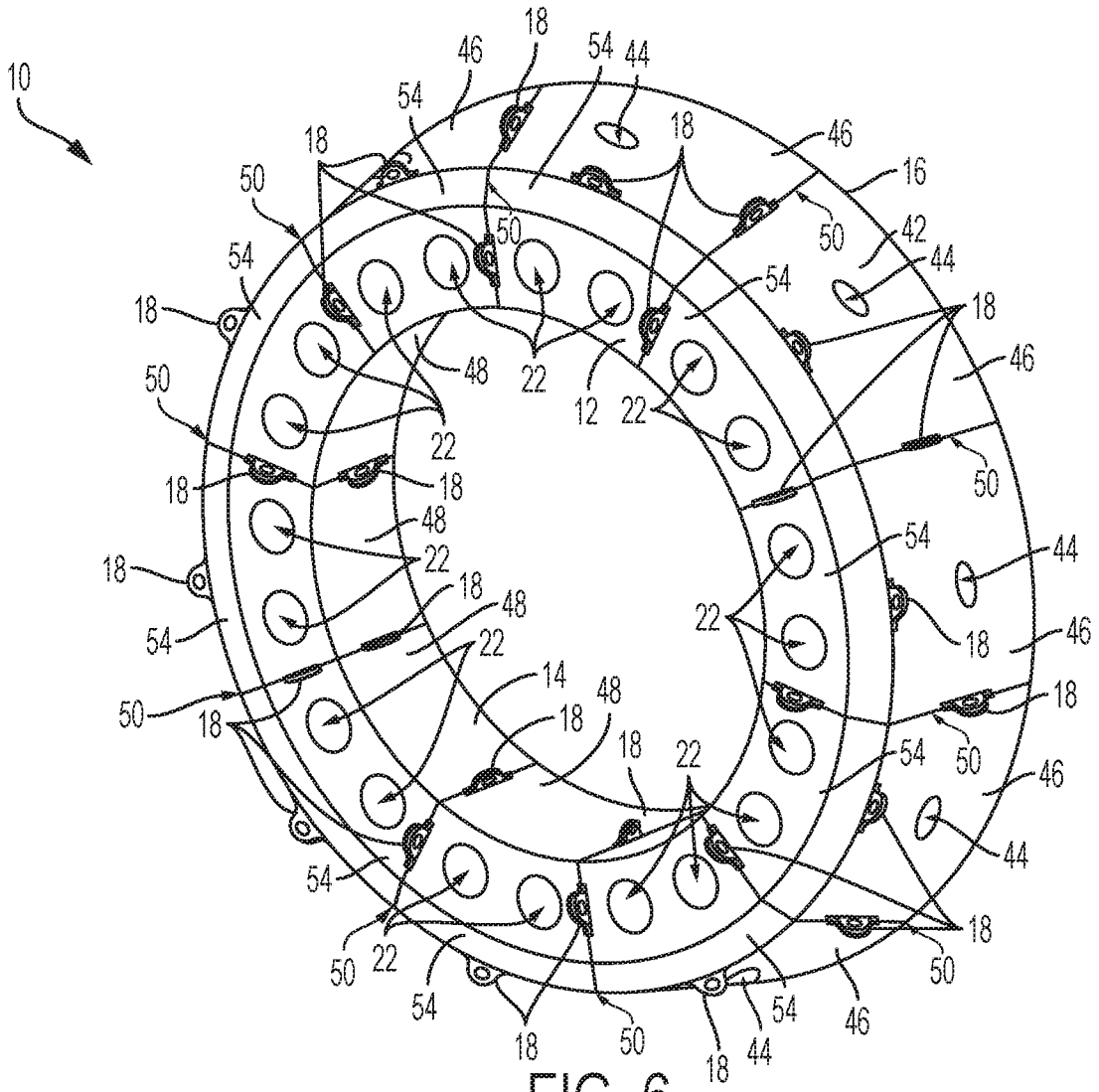
FIG. 6 illustrates a perspective front view of a fourth example of the combustor liner.

FIG. 6 illustrates an example of the combustor liner 10 with the inner wall 14 including inner wall segments 48, the outer wall 16 including outer wall segments 46, and the inlet wall 12 including multiple inlet wall segments 54. The inlet wall segments 54 may be any structure which extends around a portion of the first end 30 of the combustion chamber 34. Examples of the inlet wall segments 54 may include plates, curved panels, or brackets. Each of the inlet wall segments 54 may be coupled to adjacent inlet wall segments 54 to form the inlet wall 12. Each inlet wall segment 54 may include a flange 18 facing each adjacent inlet wall segment 54 such that the inlet wall segments 54 may be coupled together with fasteners such as nuts 38 and bolts 36.

Each inlet wall segment 54 may be identical and easily separable from the combustor liner 10. Such a configuration may reduce the cost of maintaining the combustor liner 10, as inlet wall segments 54 may be simply replaced when worn or damaged. Particularly where complex cooling channels 82 have been created in the inlet wall segment 54, manufacturing identical inlet wall segments 54 may be cost effective.

Figure 7:
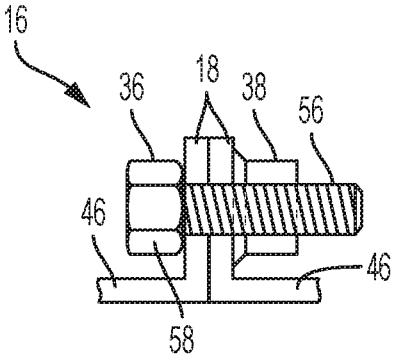
FIG. 7 illustrates a cross-sectional side view of a first example of a bolt and a nut.

FIG. 7 illustrates a bolt 36 and a nut 38 as an example of the fastener which may couple together adjacent outer wall segments 46, inner wall segments 48, or inlet wall segments 54. The bolt 36 may include a stem 56 which passes through the flange openings 20 of the flanges 18. The stem 56 may be any object which is sized to pass through the flange openings and which may be coupled to the nut 38. Examples of the stem 56 may include a threaded cylinder, a slotted cone, or any other type of projection. The head 58 of the bolt 36 may be any portion of the bolt 36 which is sized to rest against the flange 18 when the stem has passed through the flange openings 20. Examples of the head 58 may include a cylinder, a hexagonal slab, or a bar. The nut 38 may be advanced onto the stem 56 and secured such that the flanges 18 of the coupled outer wall segments 46 are secured between the head 58 of the bolt 36 and the nut 38. The bolt 36 and nut 38 may be made of any material capable of withstanding the thermal and mechanical stresses on the flanges during operation, such as stainless steel, tungsten, or a nickel superalloy. The nut 38 and bolt 36 may be loosened and separated to remove and replace an outer wall segment 46.

Figure 8:
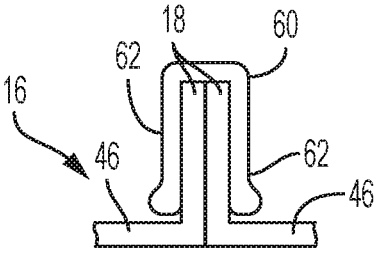
FIG. 8 illustrates a cross-sectional side view of a first example of a clamp.

Other similar fasteners may be used instead of bolts 36 and nuts 38. For example, a rivet may be advanced through the flange openings 20 and expanded to couple the flanges 18. Alternatively, as illustrated in FIG. 8, a clamp 60 may be used to couple together the flanges 18. The clamp 60 may be any object which extends around two flanges 18 to couple together the flanges 18. Examples of the clamp 60 may include a clip, a crimped sleeve, or a compressible cap. The clamp 60 may have one or more sidewalls 62 which can be secured against the surfaces of the flanges 18. In some embodiments, the flanges 18 and the sidewalls 62 may be shaped such that clamp 60 may be crimped around the flanges 18 after it has been extended over them.

Figure 9:
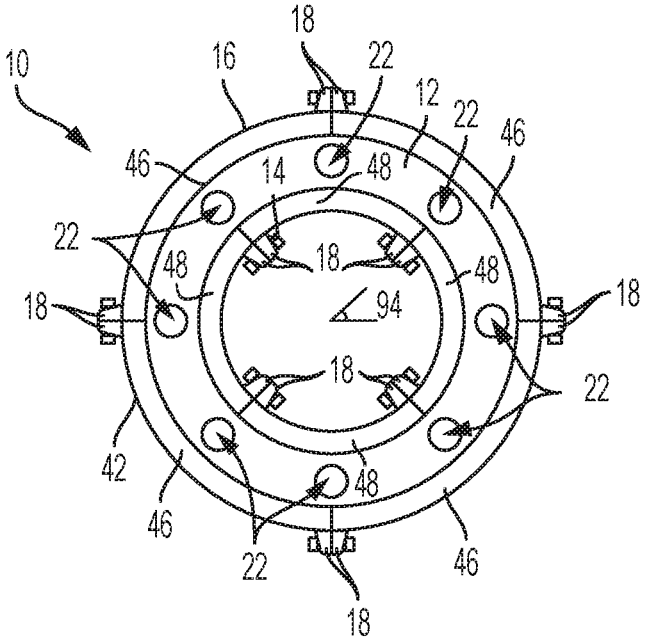
FIG. 9 illustrates a front plan view of a fifth example of the combustor liner.

FIG. 9 illustrates another example of the combustor liner 10 having multiple outer wall segments 46 and multiple inner wall segments 48. In some embodiments, the inner wall segments 48 may be angularly aligned on the circumference of the combustor liner 10 with the outer wall segments 46. In such an embodiment, the joints 50 between inner wall segments 48 may angularly overlap with the joints 50 between inner wall segments 48. Such a configuration may be advantageous for simplicity of construction of the combustor liner 10. In such a configuration, the inner wall segments 48 may have a length about the circumference of the combustor liner which is shorter than a length of the outer wall segments 46. Additionally, in such a configuration, the combustor liner 10 may include an equal number of inner wall segments 48 and outer wall segments 46.

Figure 10:
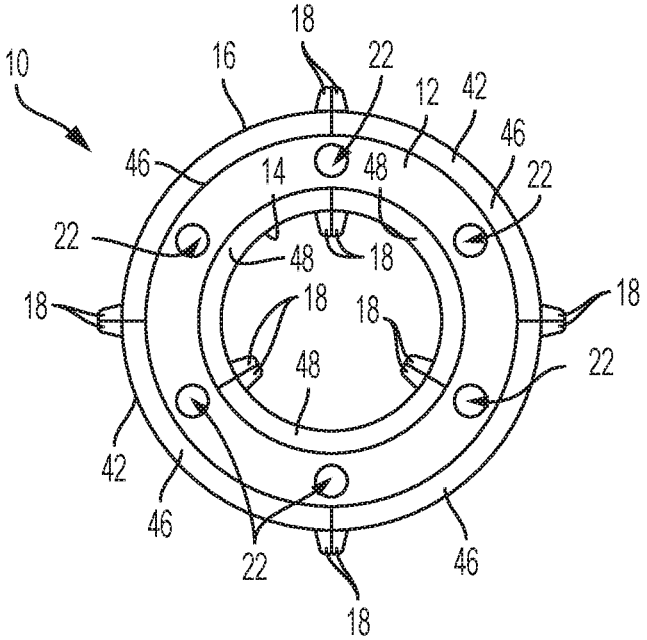
FIG. 10 illustrates a front plan view of a sixth example of the combustor liner.

FIG. 10 illustrates another example of the combustor liner 10 having multiple outer wall segments 46 and multiple inner wall segments 48. In some embodiments, the inner wall segments 48 may be angularly offset on the circumference of the combustor liner 10 from each opposing outer wall segments 46. In such an embodiment, the joints 50 between inner wall segments 48 may angularly offset from the joints 50 between inner wall segments 48 by an offset angle 94 in (FIG. 9). The offset angle 94 between the joints 50 of the outer wall segments 46 and the joints 50 of the inner wall segments 48 may be between 0 degrees and 90 degrees. Joints 50 between inner wall segments 48 and between outer wall segments 46 may leak fluid and may experience more or less thermal stress than other portions of the inner wall 14 and the outer wall 16. Such a configuration may be advantageous to distribute the joints 50 between inner wall segments 48 and between outer wall segments 46 such that any thermal or mechanical weakness caused by the joints 50 does not overlap between the inner wall 14 and the outer wall 16. In such a configuration, the inner wall segments 48 may have a length about the circumference of the combustor liner which is equal to a length of the outer wall segments 46. Additionally, in such a configuration, the combustor liner 10 may include a greater or lesser number of inner wall segments 48 than outer wall segments 46.

Figure 11:
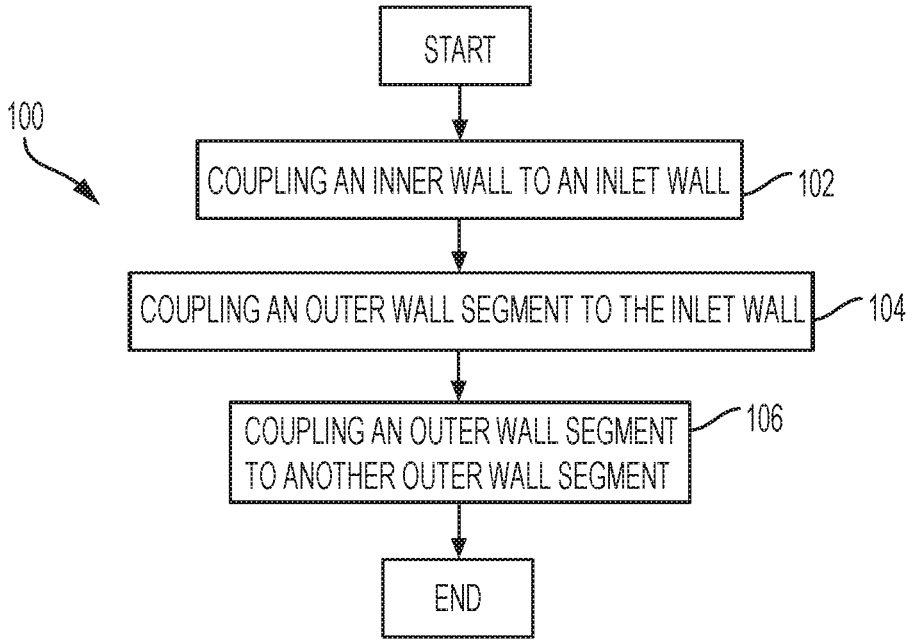
FIG. 11 illustrates a flow diagram of an example of a method of manufacturing a combustor liner.

FIG. 11 illustrates a flow diagram of an example of a method of manufacturing the combustor liner 10 for use in the combustor section 72 of the gas turbine engine 64 (100). The steps may include additional, different, or fewer operations than illustrated in FIG. 11. The steps may be executed in a different order than illustrated in FIG. 11.

The method (100) includes coupling the inner wall 14 to the inlet wall 12 (102). The inner wall 14 may be coupled to the inlet wall 12 through a variety of methods including welding, integrally forming the two components, and coupling using fasteners. The method (100) also includes coupling one of the outer wall segments 46 to the inlet wall 12 by coupling a fastener to the inlet wall 12 and to the outer wall segment 46 (104). In some embodiments, every outer wall segment 46 may be coupled to the inlet wall 12. Each of the outer wall segments 46 may extend from the first end 30 to the second end 32 of the combustor liner 10. The method (100) also includes coupling an outer wall segment 46 to another outer wall segment 45 (106). Each of the outer wall segments 46 may be coupled to adjacent outer wall segments 46 by fasteners about the entire circumference of the combustor liner 10 to form the outer wall 16. The annular combustion chamber 34 is defined within the inlet wall 12, the inner wall 14, and the outer wall 16 formed by the outer wall segments 46.

Additionally, the fasteners may be uncoupled from any of the outer wall segments 46 in order to remove and replace the outer wall segments 46. Similar steps may be taken to replace inner wall segments 48 and the inlet wall segments 54.

Each component may include additional, different, or fewer components. For example, the ports 44 and cooling channels 82 may not be included in some embodiments of the combustor liner 10. Additionally, in some embodiments, the inner wall 14 may not be divided into multiple inner wall segments 48, and the inlet wall 12 may not be divided into multiple inlet wall segments 54.

The method (100) may be implemented with additional, different, or fewer components. For example, in some embodiments of the method (100) the inner wall segments 48 may be coupled to other adjacent inner wall segments 48. This may be particularly relevant in embodiments wherein the inner wall 14 includes many inner wall segments 48.

The logic illustrated in the flow diagrams may include additional, different, or fewer operations than illustrated. The operations illustrated may be performed in an order different than illustrated.

To clarify the use of and to hereby provide notice to the public, the phrases "at least one of <A>, <B>, . . . and <N>" or "at least one of <A>, <B>, . . . <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed.

While various embodiments have been described, it will be apparent to those of ordinary skill in the art that many more embodiments and implementations are possible. Accordingly, the embodiments described herein are examples, not the only possible embodiments and implementations.

The subject-matter of the disclosure may also relate, among others, to the following aspects:

1. A combustor liner comprising:

an inlet wall having an opening into a combustion chamber;

an inner wall;

an outer wall, wherein the inner wall and the outer wall define the combustion chamber, the inner wall radially inward from the outer wall, the inner wall coupled to the inlet wall at a first end of the combustor liner, the outer wall comprising a plurality of segments, wherein the plurality of segments; and a plurality of fasteners, wherein a first portion of the plurality of fasteners couples each of the plurality of segments to another of the plurality of segments, and a second portion of the plurality of fasteners couples at least one of the plurality of segments to the inlet wall at the first end of the combustor liner.

2. The combustor liner of aspect 1, wherein the inner wall comprises a plurality of inner segments, wherein each of the plurality of inner segments is coupled to another of the plurality of inner segments by a third portion of the plurality of fasteners.

3. The combustor liner of aspect 2, wherein an inner segment is coupled to the inlet wall by a fourth portion of the plurality of fasteners.

4. The combustor liner of aspect 2, wherein the inner wall comprises the same number of inner segments as the number of segments of the outer wall.

5. The combustor liner of aspect 4, wherein each of the plurality of inner segments are angularly aligned with one of the plurality of segments of the outer wall.

6. The combustor liner of aspect 4, wherein each of the plurality of inner segments are angularly offset from an opposing segment of the plurality of segments of the outer wall.

7. The combustor liner of aspect 2, wherein each of the plurality of segments of the inner wall have a length along a circumference of the combustor liner which is the same as a length along the circumference of the combustor liner of each of the plurality of segments of the outer wall.

8. The combustor liner of aspect 1, wherein each of the plurality of fasteners is removable, and wherein, if all fasteners have been removed from any one of the plurality of segments, the one of the plurality of segment is detachable from the outer wall.

9. The combustor liner of aspect 1, wherein each of the plurality of segments is coupled to another of the plurality of segments on a first side by three fasteners.

10. The combustor liner of aspect 1, wherein each of the plurality of segments is coupled to the inlet wall by two fasteners.

11. The combustor liner of aspect 1, wherein the inlet wall comprises a plurality of inlet segments, and wherein each of the inlet segments is coupled to another of the plurality of inlet segments by a fifth portion of the plurality of fasteners.

12. A combustion assembly, comprising:

a combustor section comprising a combustor liner comprising an inlet wall arranged at a first end of the combustor liner, an inner wall extending from the first end to a second end of the combustor liner, and an outer wall extending from the first end to the second end of the combustor liner, wherein an annular combustion chamber is defined within the inlet wall, the inner wall, and the outer wall, wherein the outer wall comprises a plurality of segments, wherein each of the plurality of segments is coupled to another of the plurality of segments by a first portion of a plurality of fasteners, wherein each of the plurality of segments extends from the first end to the second end of the combustor liner, and wherein each of the plurality of segments is coupled to the inlet wall by a second portion of the plurality of fasteners, wherein the combustor section is configured to be coupled to a turbine section.

13. The combustion assembly of aspect 12, wherein the outer wall of the combustor liner comprises an interfacing feature at the second end of the combustor liner, wherein the interfacing feature is configured to be coupled to the turbine section.

14. The combustion assembly of aspect 12, wherein the outer wall comprises an outer surface having an opening in fluid communication with the combustion chamber.

15. The combustion assembly of aspect 12, wherein each of the first portion of fasteners comprises a bolt comprising a stem extending through two of the plurality of segments, and a nut coupled to the stem of the bolt.

16. The combustion assembly of aspect 12, wherein each of the first portion of fasteners comprises a rivet.

17. The combustion assembly of aspect 12, wherein each of the plurality of segments comprises a flange extending outwardly from an outer surface of each segment, and wherein each of the first portion of fasteners comprises a clamp coupled to a flange of at least two adjacent segments.

18. A method of manufacturing a combustor liner for use in a combustor of a gas turbine engine, comprising:

coupling an inner wall to an inlet wall;

coupling a first outer wall segment of a plurality of outer wall segments to the inlet wall by coupling a first fastener to the inlet wall and the first outer wall segment, wherein each of the plurality of outer wall segments extends from a first end to a second end of the combustor liner; and coupling a second outer wall segment of the plurality of outer wall segments to the first outer wall segment by coupling a second fastener to the first outer wall segment and the second outer wall segment, wherein an annular combustion chamber is defined within the inlet wall, the inner wall, and an outer wall formed by the plurality of outer wall segments.

19. The method of aspect 18, further comprising:

uncoupling the fasteners from one of the plurality of outer wall segments; and after uncoupling the fasteners, removing the one of the plurality of outer wall segments.

20. The method of aspect 19, further comprising:

after removing the one of the plurality of outer wall segments, coupling a replacement outer wall segment to the inlet wall by coupling the first fastener to the inlet wall and the replacement outer wall segment, and coupling the replacement outer wall segment to another of the plurality of outer wall segments, wherein while coupling the replacement outer wall segment, the combustor is coupled to a compressor section at a first end, and a turbine section at a second end.

What is claimed is:

1. A combustor liner comprising:

an inlet wall having an opening into a combustion chamber, the inlet wall circumferentially extending about a centerline of the combustor liner, and the inlet wall comprising a plurality of inlet segments;

an inner wall;

an outer wall, wherein the inner wall and the outer wall define the combustion chamber, the inner wall radially inward from the outer wall, the inner wall coupled to the inlet wall at a first end of the combustor liner, the outer wall comprising a plurality of outer segments; and a plurality of fasteners, wherein a first portion of the plurality of fasteners couples each of the plurality of outer segments to another of the plurality of outer segments, and a second portion of the plurality of fasteners couples at least one of the plurality of outer segments to the inlet wall at the first end of the combustor liner, wherein the plurality of inlet segments comprises a plurality of first ends and a plurality of second ends, each of the plurality of inlet segments circumferentially extending from a respective first end to a respective second end of the plurality of ends, wherein the plurality of inlet segments each comprises a respective two of a plurality of circumferentially facing segment mating surfaces, each inlet segment circumferentially extending from one to another of the respective two of the plurality of circumferentially facing segment mating surfaces, wherein each circumferentially facing segment mating surface mates with another one of the plurality of circumferentially facing segment mating surfaces, wherein the plurality of inlet segments each further comprises a respective two of a plurality of inlet flanges, each inlet flange comprising an associated one of a plurality of circumferentially facing flange mating surfaces, wherein each circumferentially facing flange mating surface mates with another one of the plurality of circumferentially facing flange mating surfaces to form a plurality of pairs of mating inlet flanges, wherein each circumferentially facing flange mating surface is coplanar with, and axially extends from, a respective one of the plurality of circumferentially facing segment mating surfaces, wherein each of a plurality of inlet fasteners fasten a respective one of the plurality of pairs of mating inlet flanges, and wherein each inlet segment of the plurality of inlet segments is configured to be coupled to two adjacent inlet segments of the plurality of inlet segments in response to a pair of inlet fasteners of the plurality of inlet fasteners fastening a respective two pairs of mating inlet flanges of the plurality of pairs of inlet flanges, and to be uncoupled from the two adjacent inlet segments upon removal of the pair of inlet fasteners from the respective two pairs of mating inlet flanges.

2. The combustor liner of claim 1, wherein the inner wall comprises a plurality of inner segments, wherein each of the plurality of inner segments is coupled to another of the plurality of inner segments by a third portion of the plurality of fasteners.

3. The combustor liner of claim 2, wherein an inner segment of the plurality of inner segments is coupled to the inlet wall by a fourth portion of the plurality of fasteners.

4. The combustor liner of claim 2, wherein the inner wall comprises the same number of inner segments as the number of outer segments of the outer wall.

5. The combustor liner of claim 2, wherein each of the plurality of inner segments of the inner wall have a length along a circumference of the combustor liner which is the same as a length along the circumference of the combustor liner of each of the plurality of outer segments of the outer wall.

6. The combustor liner of claim 1, wherein the first portion of the plurality of fasteners comprises a plurality of sets of three fasteners, wherein each of the plurality of outer segments is coupled to another of the plurality of outer segments by a respective one of the plurality of sets of three fasteners.

7. The combustor liner of claim 1, wherein the second portion of the plurality of fasteners comprises a plurality of sets of two fasteners, wherein each of the plurality of outer segments is coupled to the inlet wall by two fasteners.

8. A combustion assembly, comprising:

a combustor section comprising a combustor liner comprising an inlet wall circumferentially extending about a centerline of the combustion assembly and arranged at a first end of the combustor liner, an inner wall extending from the first end to a second end of the combustor liner, and an outer wall extending from the first end to the second end of the combustor liner, wherein an annular combustion chamber is defined within the inlet wall, the inner wall, and the outer wall, wherein the outer wall comprises a plurality of outer segments, wherein each of the plurality of outer segments is coupled to another of the plurality of outer segments by a first portion of a plurality of fasteners, wherein each of the plurality of outer segments extends from the first end to the second end of the combustor liner, and wherein each of the plurality of outer segments is coupled to the inlet wall by a second portion of the plurality of fasteners, wherein the combustor section is configured to be coupled to a turbine section, wherein the inlet wall comprises a plurality of inlet segments, the plurality of inlet segments comprises a plurality of first ends and a plurality of second ends, each of the plurality of inlet segments circumferentially extending from a respective first end to a respective second end, wherein the plurality of inlet segments each comprises a respective two of a plurality of circumferentially facing segment mating surfaces, each inlet segment circumferentially extending from one to another of the respective two of the plurality of circumferentially facing segment mating surfaces, wherein each circumferentially facing segment mating surface mates with another one of the plurality of circumferentially facing segment mating surfaces, wherein the plurality of inlet segments each further comprises a respective two of a plurality of inlet flanges, each inlet flange comprising an associated one of a plurality of circumferentially facing flange mating surfaces, wherein each circumferentially facing flange mating surface mates with another one of the plurality of circumferentially facing flange mating surfaces to form a plurality of pairs of mating inlet flanges, wherein each circumferentially facing flange mating surface is coplanar with, and axially extends from, a respective one of the plurality of circumferentially facing segment mating surfaces, wherein each of a plurality of inlet fasteners fasten a respective one of the plurality of pairs of mating inlet flanges, and wherein each inlet segment of the plurality of inlet segments is configured to be coupled to two adjacent inlet segments of the plurality of inlet segments in response to a pair of inlet fasteners of the plurality of inlet fasteners fastening a respective two pairs of mating inlet flanges of the plurality of inlet flanges, and to be uncoupled from the two adjacent inlet segments upon removal of the pair of fasteners from the respective two pairs of mating inlet flanges.

9. The combustion assembly of claim 8, wherein the outer wall of the combustor liner comprises an interfacing feature at the second end of the combustor liner, wherein the interfacing feature is configured to be coupled to the turbine section.

10. The combustion assembly of claim 8, wherein the outer wall comprises an outer surface having an opening in fluid communication with the combustion chamber.

11. The combustion assembly of claim 8, wherein each of the first portion of fasteners comprises a bolt comprising a stem extending through two of the plurality of outer segments, and a nut coupled to the stem of the bolt.

12. The combustion assembly of claim 8, wherein each of the first portion of fasteners comprises a rivet.

13. The combustion assembly of claim 8, wherein each of the plurality of outer segments comprises a flange extending outwardly from an outer surface of each outer segment, and wherein each of the first portion of fasteners comprises a clamp coupled to a flange of at least two adjacent segments.

* * * * *